United States Patent [19]

Tucker et al.

[11] 4,140,325

[45] Feb. 20, 1979

[54] TOY VEHICLE

[75] Inventors: James E. Tucker, Oak Park; Burton C. Meyer, Downers Grove, both of Ill.

[73] Assignee: Marvin Glass & Associates, Chicago, Ill.

[21] Appl. No.: 833,232

[22] Filed: Sep. 14, 1977

[51] Int. Cl.[2] ..... A63G 19/00

[52] U.S. Cl. ..... 280/1.14; 198/515

[58] Field of Search ..... 280/1.1 R, 1.11 R, 1.13, 280/1.14, 1.189, 1.201, 1.208, 1.22; 198/515, 310; 56/328 R; 214/355, 356; 46/103, 141, 204

[56] References Cited

U.S. PATENT DOCUMENTS

| | | | |
|---|---|---|---|
| 2,464,338 | 3/1949 | Morris | 280/1.14 |
| 3,197,918 | 8/1965 | Coggeshall | 46/103 |

FOREIGN PATENT DOCUMENTS

| | | | |
|---|---|---|---|
| 873669 | 4/1953 | Fed. Rep. of Germany | 46/14 |

*Primary Examiner*—John A. Pekar
*Assistant Examiner*—R. Schrecengost
*Attorney, Agent, or Firm*—Mason, Kolehmainen, Rathburn & Wyss

[57] ABSTRACT

A riding toy vehicle for picking up objects from a playing surface such as the floor, comprises a vehicle body having a seat, an open mouth adjacent the forward end and a bottom wall rearward of the mouth for holding the objects as they are picked up. A pair of front and rear wheels are provided for supporting the body for movement over the playing surface and a pair of pick up members are mounted for rotation in the mouth and are driven independently by the front wheels for engaging the objects on the playing surface and moving them upwardly onto the bottom wall of the body through the open mouth. A deflectable tongue is provided to extend downwardly towards the bottom wall for retaining the objects that are picked up once they are positioned on the bottom wall in the vehicle body.

14 Claims, 6 Drawing Figures

TOY VEHICLE

BACKGROUND OF THE INVENTION

1. Field of the Invention

The present invention relates to riding toy vehicles and is especially adapted for use by young children.

More specifically, the toy vehicle is designed for picking up objects such as blocks and the like from the floor as the vehicle is driven around by the child during play.

2. Description of the Prior Art

U.S. Pat. No. 4,031,659, issued June 28, 1977 is directed towards a push type toy pick-up vehicle for children and the like. This toy vehicle resembles a truck and is provided with a paddle wheel formed of soft spongy material to provide friction and yieldability as the paddle wheel rotates to engage objects on the floor and scoop them up into a receptacle in the rear of the vehicle body.

The toy vehicle of the present invention is directed towards a new and improved riding toy wherein the vehicle is driven by the rider over a floor or other playing surface and which is capable of picking up blocks, balls and other small objects from the playing surface and moving them into a holding section at the rear of the hollow body of the vehicle. The vehicle is styled with a dress resembling a large frog and the objects picked up move through the large open mouth of the frog. A pair of rotating flippers or pick up members are driven independently of each other by the front wheels of the vehicle as it is moved along the surface and these flippers propel the objects rearwardly into a rearward portion of the hollow vehicle body.

It is an object of the present invention to provide a new and improved riding toy vehicle for children and the like.

More particularly, it is an object of the present invention to provide a toy vehicle of the character described adapted for picking up small playing objects such as balls, blocks and the like from the floor or other playing surface as the vehicle is driven around the floor by a child.

Another object of the present invention is to provide a new and improved toy vehicle which is designed to resemble an animated creature such as a large, open mouthed, frog.

Yet another object of the invention is to provide a new and improved toy vehicle of the character described wherein one or more rotatable pick up members resembling flippers of a frog are mounted in the forward open mouth of the vehicle body to rotate and move objects from the floor surface into a rearward receptacle in the vehicle body as the vehicle is moved around the floor.

Yet another object of the invention is to provide a new and improved vehicle of the character described having novel means for retaining any objects picked up and which means resemble the broad tongue of the frog-like creature which the vehicle is styled to resemble.

Another object of the present invention is to provide a new and improved toy vehicle of the character described which is pleasing in appearance, relatively economical to produce, fun to play with and which provides action for young children.

Another object of the present invention is to provide a new and improved toy vehicle for picking up small objects from the playing surface which also includes a noise generating device for making a sound like a frog or other animal creature that the vehicle is styled to represent.

BRIEF SUMMARY OF THE INVENTION

The foregoing and other objects and advantages of the present invention are accomplished in an illustrated embodiment herein, comprising a new and improved riding toy vehicle adapted for picking up playing objects such as blocks, balls, dominoes, etc. from a playing surface such as the floor. The toy vehicle includes a hollow body resembling a large frog and having a large open mouth adjacent the forward end with a bottom wall rearward of the mouth forming the bottom of a receptacle for holding the playing objects that are picked up. A pair of front and rear wheels are provided for supporting the vehicle as it is moved over the floor and a pair of pick up members shaped to resemble the flippers or feet of a frog-like creature are mounted for rotation in the open mouth and these are independently driven by the front wheels to engage objects on the floor and move then into the rear of the vehicle body as the vehicle is moved across the floor. A deflectable tongue extends downwardly in the hollow body towards the bottom wall and operates to normally retain the objects picked up from the floor in the rearward portion of the hollow body behind the lower end of the tongue. A sound generating device actuated by rotation of the wheels is provided to further animate the toy vehicle which is styled in the dress of a large frog or frog-like creature.

BRIEF DESCRIPTION OF THE DRAWINGS

For a better understanding of the present invention, reference should be had to the following detailed description taken in conjunction with the drawings in which.

DESCRIPTION OF THE PREFERRED EMBODIMENT

Figures 1, 2, 3, 4, 5, 6:
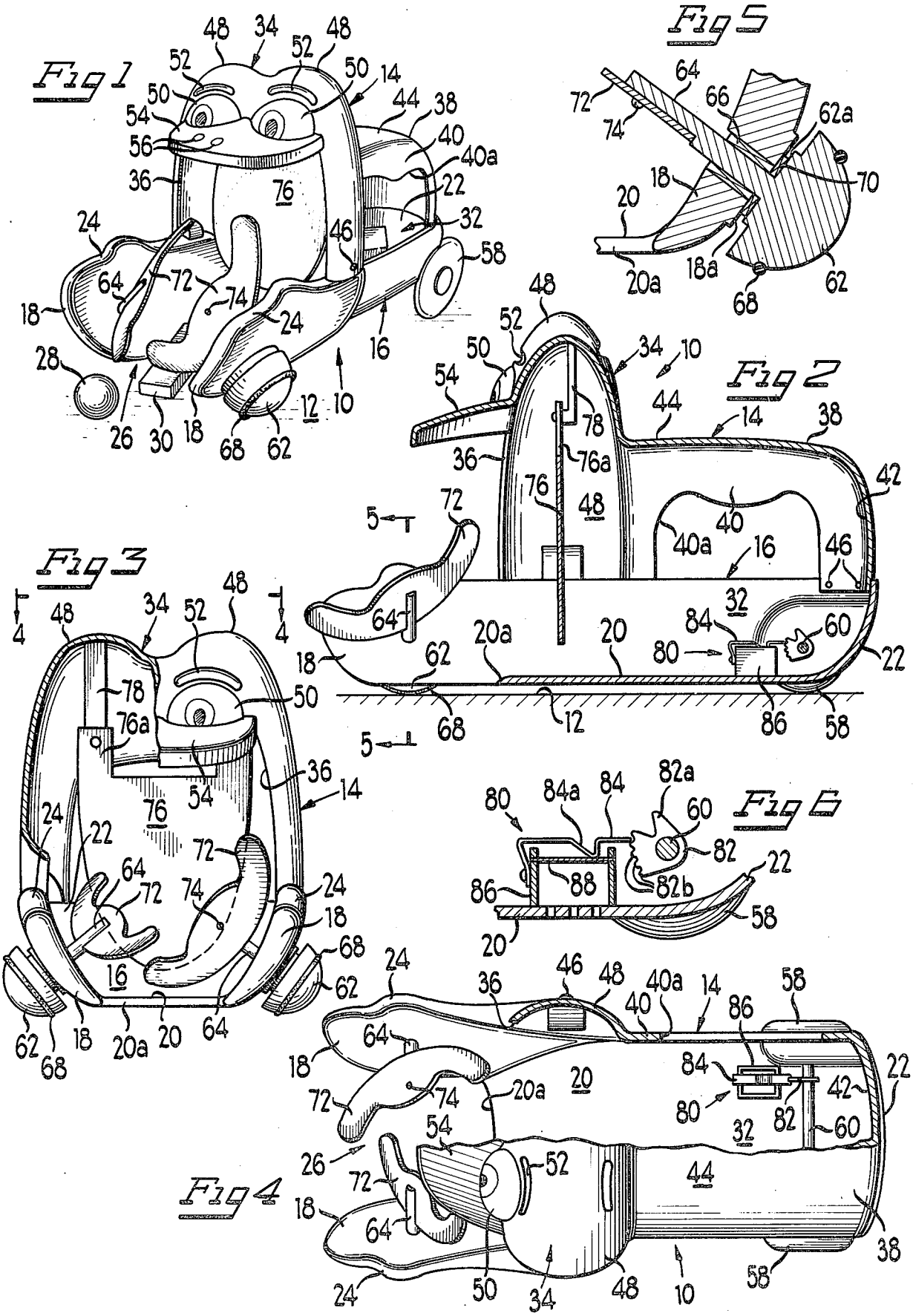
FIG. 1 is a front perspective view of a new and improved toy vehicle constructed in accordance with the features of the present invention.
FIG. 2 is a vertical longitudinal sectional view of the toy vehicle of FIG. 1.
FIG. 3 is a front elevational view of the toy vehicle with portions shown in cut-away for a better understanding of the interior construction.
FIG. 4 is a top plan view of the toy vehicle taken substantially along lines 4–4 of FIG. 3 with portions shown in cut-away.
FIG. 5 is an enlarged fragmentary sectional view taken substantially along lines 5—5 of FIG. 2.
FIG. 6 is a fragmentary vertical sectional view showing an enlarged detail the construction of the sound generating device of the toy vehicle.

Referring now more particularly to the drawings, therein is illustrated a new an improved toy vehicle especially adapted for picking up objects from the floor or other playing surface. The vehicle is referred to generally by the reference numeral 10 is shaped and decorated to resemble a large, open mouthed frog which is easily moved over a floor surface 12. In accordance with the invention, the toy vehicle includes a body indicated generally by the reference numeral 14 having a hollow base portion 16 formed with a pair of opposite longitudinal side walls 18 spaced apart by a thin flat bottom wall 20 which transitions upwardly at the rear into a curved rear end wall 22. As best shown in FIG. 2, adjacent the forward end of the body the side walls 18 are formed with irregular shaped upper edges designated as 24 resembling the lips of a large, open mouth 26 for scooping up objects such as a ball 28, a block 30, dominoes, etc. as shown in FIG. 1. As the toy vehicle 10 is moved around the floor, these blocks and other objects pass into the wide, open mouth 26 and are moved upwardly and rearwardly above a forward or leading edge 20*a* of the bottom wall 20. The objects thus picked up, move toward the end portion of the body and are retained by the side walls 18 and rear wall 22 which form a containing compartment 32 in the vehicle body.

The vehicle body includes a large upstanding hollow head portion 34 or upper half having a mouth opening 36 at the forward end and a lower and rearwardly extending hollow portion 38 at the rear comprising a pair of upstanding side walls 40, an integral rear wall 42 and a top wall or seat 44 best shown in FIG. 2. The top wall 44 provides a convenient seat for the rider and the side walls 40 are provided with irregular shaped openings 40*a* which permit viewing of the interior of the body. The head portion 34 can be conveniently grasped by the hand of the rider seated on the seat 44 to propel and direct the vehicle. The head portion 34 is secured to the upper edge portions of the hollow, lower body half 16 by a plurality of fasteners 46 to form the completed hollow body 14. At the forward end, the upper half includes a high portion with a pair of upstanding side faces 48 having domed shaped tops resembling a dimpled forehead and on each of the faces a forward wall section is provided to accommodate a decorative large eyeball 50 with an eyebrow 52 spaced above. Below the eyeballs, the hollow head is formed with an outwardly and forwardly extending nose portion 54 having decorative nostrils 56 thereon and the nose portion forms an upper wall above the enlarged mouth opening 36.

The vehicle body 14 is supported for movement over the floor by a pair of rear wheels 58 carried on a rear axle 60 and a pair of independently supported hemispherically shaped front wheels 62 mounted for rotation on integral supporting axles 64 which slope laterally outwardly and downwardly through hollow bearing sleeves 66 (FIG. 5) mounted in openings in the forward end portion of the side walls 18 which form the sides of the open mouth 26.

As best shown in FIG. 5, the front wheels 62 and their supporting axles 64 are integrally formed and each front wheel is provided with an annular rubber tire 68 for engagement with the floor or other surface. As illustrated in FIG. 3, the front wheels are independent of one another and are rotated by movement of the vehicle over the floor. The outer surfaces of the side walls 18 around the front wheel shaft openings are formed in annular flat bearing planes 18*a* against which washers 70 are mounted to provide for smooth rotation of the wheels. The outer surface of these washers bear against an annular flat face 62*a* on the inside of the hemispherical wheels. It will thus be seen that the toy pick-up vehicle 10 may be easily driven or pushed over the floor 12 by a child and engagement of the tires with the floor causes the shafts 64 to rotate independent of each other. These shafts project upwardly into the open mouth 26 from opposite sides and each supports a flipper or pick up element 72 attached to a flatted portion of the shaft as shown in FIG. 5 by a suitable fastener 74. As illustrated, the pick up elements 72 are shaped with irregular upper edges and resemble the flippers or feet of a frog. As the flippers rotate, they engage objects on the floor and move or flip these objects upwardly and rearwardly through the open mouth 26 toward the storage compartment 32 in the rear portion of the vehicle body. As illustrated in FIG. 3, the paths transversed by the outer ends of the respective flippers 72 may overlap slightly so that as the flippers rotate independently, most of the objects in the path of the vehicle will be picked up by one or the other of the flippers.

The vehicle is provided with depending tongue 76 formed of flexible material and appropriately colored or decorated like a frog's tongue. The tongue is deflectable rearwardly as picked up objects pass beneath the lower edge portion towards the rear section 32 of the vehicle body. At the upper end, the tongue is formed with a pair of upwardly projecting mounting elements 76*a* which are attached to depending brackets 78 integrally formed on the inside of the domed upper ends of the side faces 48 of the hollow head. The tongue 36 is shaped with a rounded lower edge and as shown in FIGS. 2 and 3, is spaced above the upper surface of the floor 20 to permit the picked up elements to pass rather easily into the rear storage compartment 32 of the hollow body 14. The tongue helps to prevent picked up objects from moving forwardly into the open mouth. After a number of objects have been picked up or when the rear compartment 32 is full, the vehicle may be picked up and tilted downwardly and these objects will deflect the tongue and drop out the open mouth. Play may then be continued with further movement of the vehicle around the floor to pick up the objects dropped out or other objects.

In order to make play with the vehicle 10 more fun and realistic, there is provided a two tone sounding means or sound generating device 80 (FIGS. 2, 4 and 6) mounted in the rear storage compartment 32 of the body on a rearward portion of the bottom wall 20 adjacent the rear axle 60. The sound generating device includes an irregularly shaped cam 82 mounted on the shaft 60 rotated therewith. The cam includes a large finger or cam portion 82*a* and a plurality of smaller fingers or cam undulations 82*b* spaced therefrom and adapted to engage and deflect the outer free end of a spring member 84 which is attached to an upstanding side wall of hollow sound box 86 in a timed relationship. The sound box is of rectangular cross-section and is integrally formed with the upper surface of the bottom wall 20 of the vehicle body. A vibrating reed 88 extends between front and rear walls of the sound box and the deflectable spring 84 includes a downwardly extending finger 84*a* adapted to engage and vibrate the reed 88 to generate a frog-like sound. The bottom wall 20 of the vehicle forms a lower end of the hollow sound box 86 and this wall is formed with a plurality of tuned openings 28 shown in FIG. 6.

As previously indicated and described in the drawings, the vehicle 10 is designed to resemble a large frog with an open mouth and the sound generated by the two tone sound generating device 80 is designed to simulate the sound of a croaking bull frog which begins with several low volume tones followed by a final high volume tone. As the vehicle is moved, the rear axle 60 and the cam 82 rotate and the fingers 82*a* and 82*b* of the cam cause the spring finger 84*a* to deflect and engage the reed 88 which generates a sound or noise similar to the sound of a croaking frog.

Although the present invention has been described with reference to a single illustrated embodiment thereof it should be understood that numerous other modifications and embodiments can be devised by those skilled in the art that will fall within the spirit and scope of the principles of this invention.

What is claimed as new and desired to be secured by Letters Patent of the United States is:

1. A riding toy vehicle for picking up objects from a playing surface comprising:

a vehicle body having an opening adjacent a forward end and bottom wall rearward of said opening for holding objects picked up;

front and rear wheel means for supporting said body for movement over said playing surface;

at least one pick up member mounted for rotation in said opening and driven by said front wheel means for engaging objects on said playing surface and moving them onto said bottom wall in said body; and a deflectable portion extending downwardly toward said bottom wall for retaining objects picked up on said bottom wall rearwardly of said opening.

2. The riding toy vehicle of claim 1 including sounding means for producing a two tone audio signal.

3. A riding toy vehicle for picking up objects from a playing surface comprising:

a vehicle body having an opening adjacent a forward end and a bottom wall rearward of said opening for holding objects picked up;

front and rear wheel means for supporting said body for movement over said playing surface;

at least one pick up member mounted for rotation in said opening and driven by said front wheel means for engaging objects on said playing surface and moving them onto said bottom wall in said body; and handle means above said bottom wall including an enclosure above said bottom wall with at least one opening in a side portion for retrieving objects.

4. A riding toy vehicle for picking up objects from a playing surface comprising:

a vehicle body having an opening adjacent a forward end and a bottom wall rearward of said opening for holding objects picked up;

front and rear wheel means for supporting said body for movement over said playing surface; and at least one pick up member mounted for rotation in said opening and driven by said front wheel means for engaging objects on said playing surface and moving them onto said bottom wall in said body, said pick up member being mounted on an axle sloping upwardly and inwardly into said mouth from one side thereof.

5. The riding toy vehicle of claim 4 wherein said front wheel means include a front wheel mounted on said axle outwardly of said one side of said mouth.

6. The riding toy vehicle of claim 4 including another pick up member mounted on a second axle sloping upwardly and inwardly into said mouth from an opposite side thereof.

7. The riding toy vehicle of claim 6 wherein said wheel means includes a second front wheel mounted on said second axle outwardly of said mouth.

8. A riding toy vehicle for picking up objects from a playing surface, comprising:

a vehicle body having an opening adjacent a forward end and a bottom wall rearward of said opening for holding objects picked up;

front and rear wheel means for supporting said body for movement over said playing surface; and a pair of pick up members mounted on opposite sides of said opening for rotation about circular paths convergent toward a lower central portion of said opening and driven by said front wheel means for engaging objects on said playing surface and moving them onto said bottom wall in said body.

9. The riding toy vehicle of claim 8 wherein said front wheel means includes a pair of front wheels independent of each other and each drivingly connected to one of said pick up members.

10. The riding toy vehicle of claim 9 wherein said pick up members are mounted on independent shafts extended outwardly and downwardly from opposite side walls of said mouth and said front wheels are mounted on outer end portions of said shafts.

11. The riding toy vehicle of claim 9 including a seat portion for supporting a rider on the vehicle.

12. A riding toy vehicle for picking up objects from a playing surface, comprising:

a vehicle body having an opening adjacent a forward end and a bottom wall rearward of said opening for holding objects;

front and rear wheel means for supporting said body for operator movement over said playing surface;

a pair of pick up members mounted on opposite sides of said opening for rotation and driven by said front wheel means for engaging objects on said playing surface and moving them onto said bottom wall in said body; and a deflectable portion extending downwardly toward said bottom wall concealing at least some of said objects on said bottom wall rearwardly thereof.

13. The riding toy vehicle of claim 12 wherein said vehicle body is formed generally in the shape of a frog.

14. The riding toy vehicle of claim 13 including sounding means for producing a two tone audio signal simulating a frog.

* * * * *